US012089686B2

(12) United States Patent
Nakashima et al.

(10) Patent No.: US 12,089,686 B2
(45) Date of Patent: Sep. 17, 2024

(54) HELMET

(71) Applicant: OGK KABUTO CO., LTD., Higashi-Osaka (JP)

(72) Inventors: Yoshito Nakashima, Higashi-Osaka (JP); Takeshi Murakami, Higashi-Osaka (JP); Toru Fukuda, Higashi-Osaka (JP)

(73) Assignee: OGK KABUTO CO., LTD., Higashi-Osaka (JP)

( * ) Notice: Subject to any disclaimer, the term of this patent is extended or adjusted under 35 U.S.C. 154(b) by 116 days.

(21) Appl. No.: 17/784,293

(22) PCT Filed: Dec. 16, 2019

(86) PCT No.: PCT/JP2019/049222
§ 371 (c)(1),
(2) Date: Jun. 10, 2022

(87) PCT Pub. No.: WO2021/124412
PCT Pub. Date: Jun. 24, 2021

(65) Prior Publication Data

US 2023/0041919 A1 Feb. 9, 2023

(51) Int. Cl.
*A42B 3/12* (2006.01)

(52) U.S. Cl.
CPC ..... *A42B 3/127* (2013.01)

(58) Field of Classification Search
CPC ..... A42B 3/127; A42B 3/12; A42B 1/241
See application file for complete search history.

(56) References Cited

U.S. PATENT DOCUMENTS 6,256,797 B1 * 7/2001 Nemoto ..... A42B 3/328 2/424
2001/0034895 A1 * 11/2001 Ikeda ..... A42B 3/127 2/412

(Continued)

FOREIGN PATENT DOCUMENTS

JP 2007-303007 A 11/2007
JP 2011-508112 A 3/2011

(Continued)

OTHER PUBLICATIONS

International Search Report, issued in PCT/JP2019/049222, dated Mar. 10, 2020.

(Continued)

*Primary Examiner* — Jillian K Pierorazio
(74) *Attorney, Agent, or Firm* — Birch, Stewart, Kolasch & Birch, LLP

(57) ABSTRACT

A helmet that is reliably and quickly removable from the head of a user by a third person includes a head covering shell having an insertion opening that opens downward and configured to protect the head of the user; a shock absorbing body disposed adjacent to an inner periphery of the head covering shell to reduce shock to the head of the user; and a cushion pad disposed adjacent to an inner periphery of the shock absorbing body to fill a gap between the shock absorbing body and the head. The cushion pad includes an emergency removal pad at a position along an opening edge of the insertion opening. The emergency removal pad includes a pad bag having a hollow interior, a pad body disposed in the pad bag, and a pad removal part that enables the pad body to be taken out from the pad bag attached to the opening edge of the insertion opening.

6 Claims, 8 Drawing Sheets

(56) References Cited

U.S. PATENT DOCUMENTS

| | | | | |
|---|---|---|---|---|
| 2006/0162054 | A1* | 7/2006 | Lardeau | A42B 3/127 2/414 |
| 2007/0271688 | A1 | 11/2007 | Ando | |
| 2009/0222964 | A1* | 9/2009 | Wiles | F41H 1/08 2/6.6 |
| 2010/0269246 | A1* | 10/2010 | Salomon | A42B 3/328 2/414 |
| 2011/0088147 | A1 | 4/2011 | Arai | |
| 2012/0192337 | A1* | 8/2012 | Divine | A42B 3/127 2/414 |
| 2013/0007950 | A1* | 1/2013 | Arai | A42B 3/127 2/414 |
| 2014/0237706 | A1* | 8/2014 | O'Conner | A42B 1/08 2/410 |
| 2015/0374059 | A1* | 12/2015 | Farquhar | A42B 1/048 2/412 |
| 2018/0055126 | A1* | 3/2018 | Yeung | A41D 13/0158 |
| 2018/0235304 | A1* | 8/2018 | Fischer | A42B 3/127 |
| 2018/0271202 | A1* | 9/2018 | Wiart | A63B 71/10 |
| 2019/0014839 | A1* | 1/2019 | Johnston | A41D 13/05 |

FOREIGN PATENT DOCUMENTS

| | | | | |
|---|---|---|---|---|
| JP | 2013-19067 | A | 1/2013 | |
| JP | 3221426 | U | 5/2019 | |
| KR | 20-0418539 | Y1 | 6/2006 | |
| WO | WO-2015121787 | A1 * | 8/2015 | A42B 3/127 |

OTHER PUBLICATIONS

Extended European Search Report for European Application No. 19956737.1, dated Oct. 10, 2023.

* cited by examiner

HELMET

TECHNICAL FIELD

The present invention relates to helmets used to protect the head of a user riding a motorcycle or the like, and more particularly to a helmet that is easily removable from the user's head by a third person other than the user in case of emergency.

BACKGROUND ART

Helmets are mandatory for users riding motorcycles to protect their heads. Also, helmets or the like are generally used in, for example, motor sports to protect the heads of racing drivers during crashes and rollovers. These helmets have various shapes depending on their use. When a high safety level is required, a full-face helmet that covers the entire head is often used.

General full-face helmets provide sufficient protection for the head, but have been said to be disadvantageous in that they are not easy to wear and take off. A helmet includes a head covering shell, a shock absorbing body made of styrene foam or the like provided on the inner side of the head covering shell, and a cushion pad provided on the inner side of the shock absorbing body. The cushion pad is composed of a member such as a sponge to improve the comfort of the user. The cushion pad of a full-face helmet has a particularly large thickness in a region around the neck (below the chin) that is largely spaced from the shock absorbing body. Therefore, the helmet cannot be easily removed, even by the user themselves, simply by removing a chin strap because the thick cushion pad around the neck serves as an obstruction.

The above-described full-face helmet may also be removed by a third person other than the user in case of, for example, a traffic accident or an accident during a race. In such a case, the third person is required to quickly remove the full-face helmet that cannot be easily removed even by the user themselves.

Various technologies have been developed to improve the removability of the full-face helmet.

For example, PTL 1 discloses a helmet including a recess-projection engagement mechanism for attaching a block-shaped inside pad 38b to a cap-shaped head protector. The recess-projection engagement mechanism is used to enable easy removal of the block-shaped inside pad 38b. More specifically, the recess-projection engagement mechanism according to PTL 1 includes male hooks 56 provided on the inside pad 38b and female hooks provided on the head protector. The helmet according to PTL 1 includes a pad removal member 81 having pulling means 83. The pad removal member 81 is provided with interrupt portions 87 that are inserted between the male hooks 56a and 56c and their respective female hooks to cancel the recess-projection engagement, thereby enabling easy removal of the block-shaped inside pad 38b.

CITATION LIST

Patent Literature

PTL 1: Japanese Unexamined Patent Application Publication No. 2007-303007

SUMMARY OF INVENTION

Technical Problem

According to the helmet of PTL 1, the interrupt portion 87 having a complex shape needs to be provided to enable removal of the block-shaped inside pad 38b, and it is necessary to precisely guide the interrupt portion 87 between the male and female hooks with, for example, the pulling means 83 to insert the interrupt portion 87 between the male and female hooks. Accordingly, the pad removing mechanism itself has a complex structure. Therefore, the helmet according to PTL 1 is disadvantageous in that the manufacturing costs, such as costs of components and assembly, tend to increase due to the complex structure thereof.

According to the helmet of PTL 1, the pad cannot be easily removed unless the interrupt portion 87 is reliably guided between the male and female hooks. If the interrupt portion 87 is even slightly displaced, the recess-projection engagement between the male and female hooks cannot be canceled. Therefore, it cannot be said that the helmet is sufficiently reliably removable.

A helmet other than the full-face helmet, such as an open face helmet that covers the head over a large area or a jet helmet, may also have the above-described problem.

The present invention has been made in view of the above-described problem, and an object of the present invention is to provide a helmet that has a simple structure and that is reliably and quickly removable from the user's head by a third person.

Solution to Problem

To solve the above-described problem, a helmet according to the present invention has the following technical means.

A helmet according to the present invention includes a head covering shell having an insertion opening that opens downward and configured to protect a head of a user; a shock absorbing body disposed adjacent to an inner periphery of the head covering shell to reduce shock to the head of the user; and a cushion pad disposed adjacent to an inner periphery of the shock absorbing body to fill a gap between the shock absorbing body and the head. The cushion pad includes an emergency removal pad at a position along an opening edge of the insertion opening. The emergency removal pad includes a pad bag having a hollow interior, a pad body disposed in the pad bag, and a pad removal part that enables the pad body to be taken out from the pad bag attached to the opening edge of the insertion opening.

Preferably, the emergency removal pad includes a connecting member disposed between the pad bag and the pad body to connect the pad body to the pad bag.

Preferably, the pad removal part includes a first element disposed at an opening edge of an opening formed in the pad bag at one side of the opening; a second element disposed at an opening edge of the opening at other side of the opening, the second element being capable of interlocking with the first element; and a slider that causes the first element and the second element to interlock with each other in a disengageable manner. Preferably, the connecting member is connected to the slider of the pad removal part.

Preferably, the pad body includes an upper pad disposed in an upper section of the pad bag, and a lower pad disposed below the upper pad in the pad bag, the lower pad being separable from the upper pad. Preferably, the emergency removal pad is configured to allow the lower pad to be taken out through the pad removal part while the upper pad remains in the pad bag.

Preferably, the emergency removal pad includes a thickness increasing pad capable of increasing a thickness of the pad body in an inside-outside direction and a thickness-increasing-pad attachment portion with which the thickness increasing pad is attached to the pad body.

Advantageous Effects of Invention

The helmet according to the present invention has a simple structure and is reliably and quickly removable from the user's head by a third person.

DESCRIPTION OF EMBODIMENTS

A helmet 1 according to an embodiment of the present invention will now be described in detail with reference to the drawings.

Figure 1:
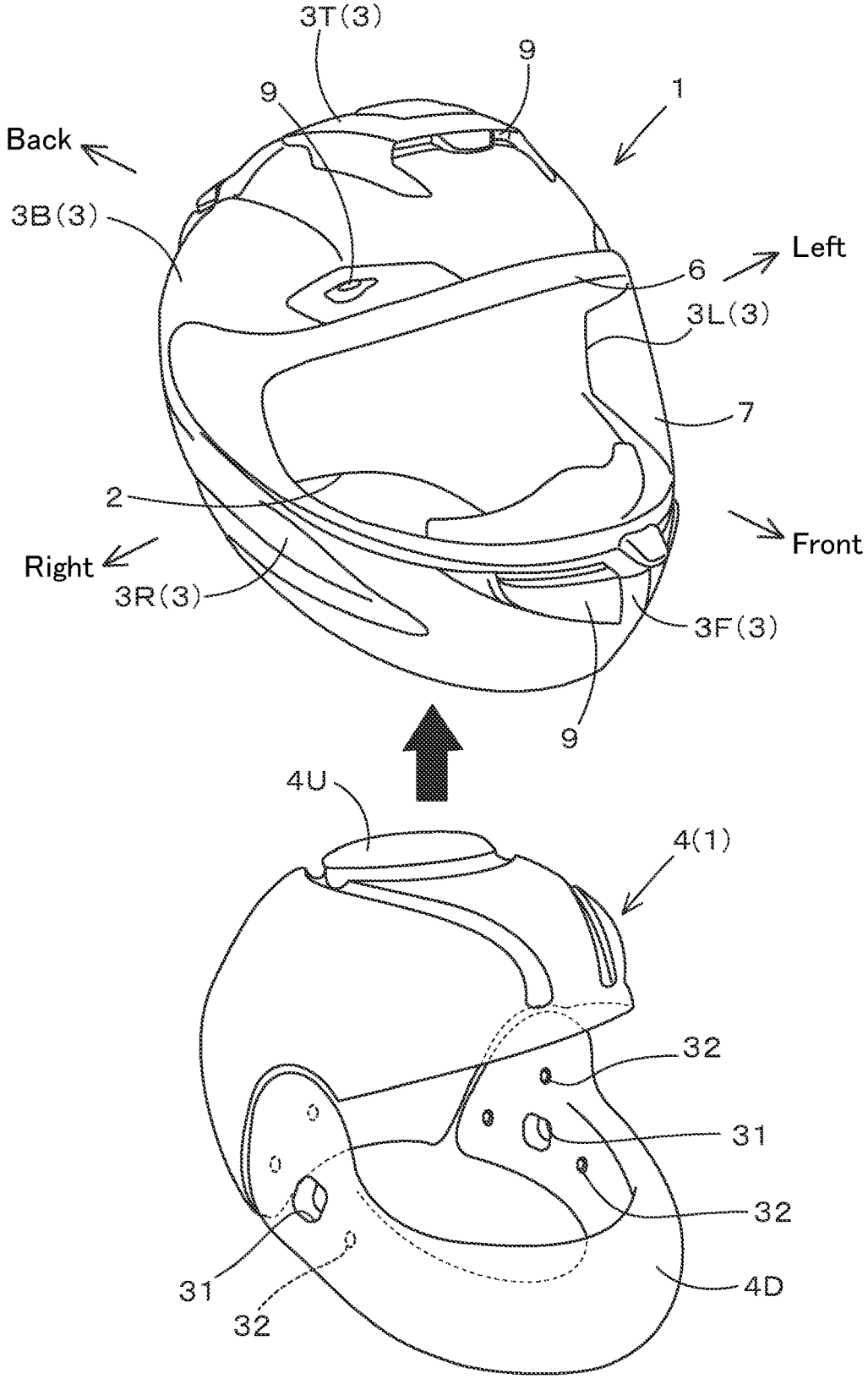
FIG. 1 is an exploded view of an outer peripheral portion of a helmet according to a present embodiment.

As illustrated in FIG. 1, the helmet 1 according to the present embodiment is a full-face helmet that covers and protects the head of a user U substantially over the entire area thereof (the entire head of the user U excluding the regions around the neck and in front of both eyes). The above-described helmet 1 has an insertion opening 2 that opens downward at the bottom thereof, and the head of the user U can be inserted into the helmet 1 through the insertion opening 2 (from below). The helmet 1 includes a head covering shell 3 disposed at the outermost periphery, a shock absorbing body 4 disposed adjacent to the inner periphery of the head covering shell 3 to reduce (absorb) shock to the head of the user U, and cushion pads 5 disposed adjacent to the inner periphery of the shock absorbing body 4 to fill the gap between the shock absorbing body 4 and the head. Thus, the helmet 1 according to the present embodiment basically has a three-layer structure including the head covering shell 3, the shock absorbing body 4, and the cushion pads 5 arranged in that order from the outer side toward the inner side.

The head covering shell 3, the shock absorbing body 4, and the cushion pads 5 that constitute the helmet 1 according to the present embodiment will now be described.

In the following description, the front-back direction, the left-right direction, and the up-down direction as viewed from the user U wearing the helmet 1 will be respectively referred to as the front-back direction, the left-right direction, and the up-down direction of the helmet 1 being described. In addition, the inner side of the helmet 1 into which the head of the user U is inserted will be referred to as the side adjacent to the inner periphery of the helmet 1 being described, and the outer side of the helmet 1 will be referred to as the side adjacent to the outer periphery of the helmet 1 being described. These directions are shown in the drawings as appropriate.

Figure 2:
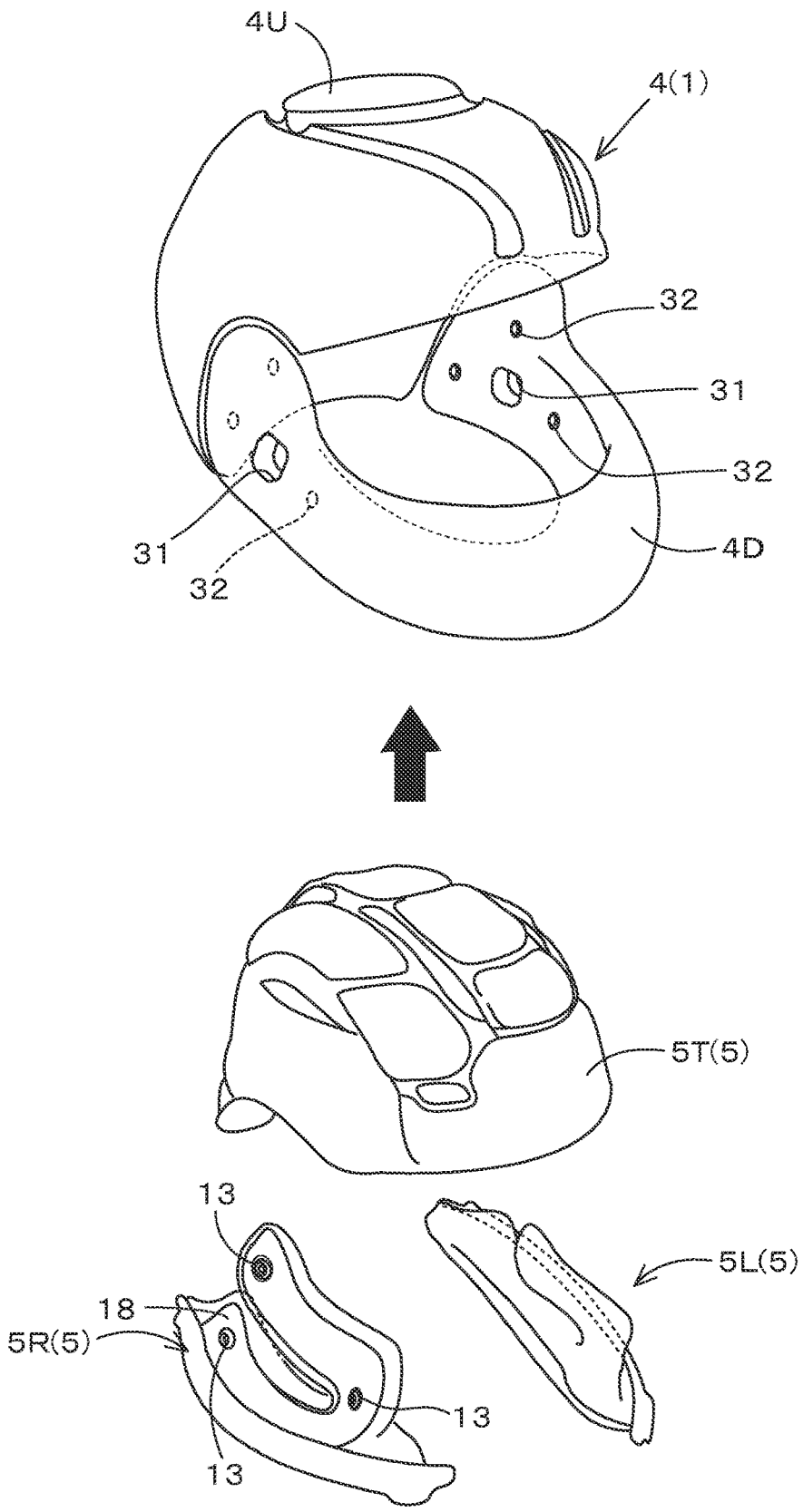
FIG. 2 is an exploded view of an inner peripheral portion of the helmet according to the present embodiment viewed from the lower right.

As illustrated in FIGS. 1 and 2, the above-described head covering shell 3 has a hemispherical shape that bulges upward, and is capable of covering the entire head of the user U excluding the regions around the neck and in front of both eyes. The head covering shell 3 is made of, for example, a rigid resin, such as ABS, or a composite material obtained by combining a rigid resin with reinforced fiber, such as carbon fiber or glass fiber.

More specifically, the head covering shell 3 includes a top covering portion 3T that covers a region around the top of the head, a back covering portion 3B that covers a region from the back of the head to the nape, a left cheek covering portion 3L that covers a region from the left side of the head to the left cheek, and a right cheek covering portion 3R that covers a region from the right side of the head to the right cheek. The head covering shell 3 has a front opening window 6, through which the user U views the outside world, at the front thereof The front opening window 6 extends from a front left region to a front right region through a front center region of the head covering shell 3. The front opening window 6 can be covered with a shield 7 (visor) attached to the exterior of the head covering shell 3 as appropriate. In addition, a chin covering portion 3F that covers the chin of the user U is provided below the front opening window 6. The chin covering portion 3F extends from the left cheek covering portion 3L to the right cheek covering portion 3R along the bottom opening edge of the front opening window 6.

The head covering shell 3 has the insertion opening 2 that opens downward at the bottom thereof. The insertion opening 2 has a substantially elliptical shape that extends in the front-back direction so that the head of the user U can be inserted through the insertion opening 2, and has an opening size corresponding to the size of the head (for example, one of six standard sizes of XS, S, M, L, XL, and XXL for a head circumference in the range of 53 cm to 64 cm). An edge guard member 8 made of a flexible PVC resin, for example, is provided along the opening edge of the insertion opening 2 to prevent the user U from coming into direct contact with the sharp edge of the head covering shell 3.

The above-described head covering shell 3 has ventilating portions 9 through which the outside air is introduced into the inside of the head covering shell 3. In the present embodiment, the ventilating portions 9 open in regions below the opening edge of the front opening window 6 and in front of the top covering portion 3T. The openings of the ventilating portions 9, which can be covered with shutters as appropriate, allow the outside air to flow into the space inside the cushion pads 5 through flow passages that extend from the openings through the head covering shell 3. Thus, stuffiness can be reduced and fogging of the shield 7 can be prevented.

Chin straps 10 are attached to the inner peripheral surface of the above-described head covering shell 3 at the left and right sides. These chin straps 10 are formed in an elongated strip shape by using a resin, such as polyester or nylon. The chin straps 10 are securely fixed to the inner peripheral surface of the head covering shell 3 by using rivets or the like so that the chin straps 10 do not become separated even when a very large force is applied in case of emergency.

The shock absorbing body 4, which is disposed inside the above-described head covering shell 3, is capable of reducing transmission of external shock applied to the head covering shell 3 to the head of the user U. The shock absorbing body 4 is made of, for example, styrene foam (EPS) or polypropylene foam (EPP) having good shock absorbing characteristics, and is capable of effectively absorbing shocks. The shock absorbing body 4 is a plate-shaped or block-shaped member that is curved in accordance with the curvature of the inner peripheral surface of the above-described head covering shell 3, and is disposed inside the head covering shell 3 to correspond to the above-described portions (the top covering portion 3T, the back covering portion 3B, the left cheek covering portion 3L, the right cheek covering portion 3R, and the chin covering portion 3F described above) of the head covering shell 3.

In the present embodiment, the shock absorbing body 4 includes an upper absorbing body 4U and a lower absorbing body 4D. The upper absorbing body 4U is disposed adjacent to the inner periphery of the top covering portion 3T and the back covering portion 3B of the head covering shell 3. The lower absorbing body 4D is disposed adjacent to the inner periphery of the left cheek covering portion 3L, the right cheek covering portion 3R, and the chin covering portion 3F of the head covering shell 3. The lower absorbing body 4D of the above-described shock absorbing body 4 has chin-strap guide holes 31 at the left and right ends thereof. The chin straps 10, which are attached to the left and right sides of the head covering shell 3, are guided into the inside of the shock absorbing body 4 through the chin-strap guide holes 31.

A total of three engagement parts 32 used to retain a pad bag 15 (emergency removal pad 12) described below are attached to each of left and right end portions of the lower absorbing body 4D at positions somewhat spaced from a corresponding one of the chin-strap guide holes 31 in forward, backward, and upward directions. In the helmet 1 according to the present embodiment, the engagement parts 32 are hook buttons. Alternatively, fabric zippers, for example, may be used instead of hook buttons.

The cushion pads 5 are disposed adjacent to the inner periphery of the above-described shock absorbing body 4 to fill the gap between the head of the user U and the above-described shock absorbing body 4. The cushion pads 5 are made of a sponge material or the like on which a synthetic fiber fabric having high water absorbency and air permeability is bonded at a side adjacent to the head (inner periphery), so that shock to the head of the user U can be reduced, that soft tactile feel can be provided, and that sweat and the like can be appropriately discharged. Since the above-described gap between the head and the shock absorbing body 4 varies depending on the location on the head, the cushion pads 5 are formed such that the thickness and position of the sponge material vary depending on the location on the head.

More specifically, the cushion pads 5 included in the helmet 1 according to the present embodiment includes a top pad 5T, a left cheek pad 5L, and a right cheek pad 5R. The top pad 5T is disposed adjacent to the inner periphery of the upper absorbing body 4U. The left cheek pad 5L and the right cheek pad 5R are disposed adjacent to the inner periphery of the lower absorbing body 4D. In the present embodiment, the left cheek pad 5L and the right cheek pad 5R are spaced from each other in the left-right direction, and no cushion pad 5 is provided in front of the mouth of the user U. The reason for this is to ensure smooth breathing of the user U. However, the helmet 1 according to the present invention may have a cushion pad 5 disposed in front of the mouth.

Among the above-described cushion pads 5, the top pad 5T is made of a thin sponge material and is thinner than the left cheek pad 5L and the right cheek pad 5R because the above-described gap between the head and the shock absorbing body 4 is small and it can be expected that additional protection can be provided by the hair. The left cheek pad 5L and the right cheek pad 5R are made of a thick sponge material and are thicker than the top pad 5T because the gap between the head and the shock absorbing body 4 is large and it is necessary to provide spaces for receiving the ears and structures for attaching the chin straps 10. Accordingly, when the helmet 1 is removed from the head of the user U by a third person in case of emergency, the left cheek pad 5L and the right cheek pad 5R, which are thick, serve as obstructions.

Accordingly, the cushion pads 5 of the present embodiment are configured such that each of the left cheek pad 5L and the right cheek pad 5R described above is composed of an emergency removal pad 12 including a pad body 14 disposed therein. The pad size (thickness) can be reduced by pulling out the pad body 14, so that the helmet 1 can be quickly removed by a third person in case of emergency. Thus, the helmet 1 according to the present invention is characterized in that the emergency removal pads 12 are provided.

The emergency removal pads 12, which characterizes the helmet 1 according to the present invention, will now be described.

The above-described left and right emergency removal pads 12 have basically the same structure and shape except that the shape and position thereof may be reversed in the left-right direction depending on whether the location thereof is on the left side or the right side of the head covering shell 3. Therefore, in the following description, the emergency removal pad 12 included in the right cheek pad 5R will be described as an example of the emergency removal pad 12 according to the present invention.

Figure 3:
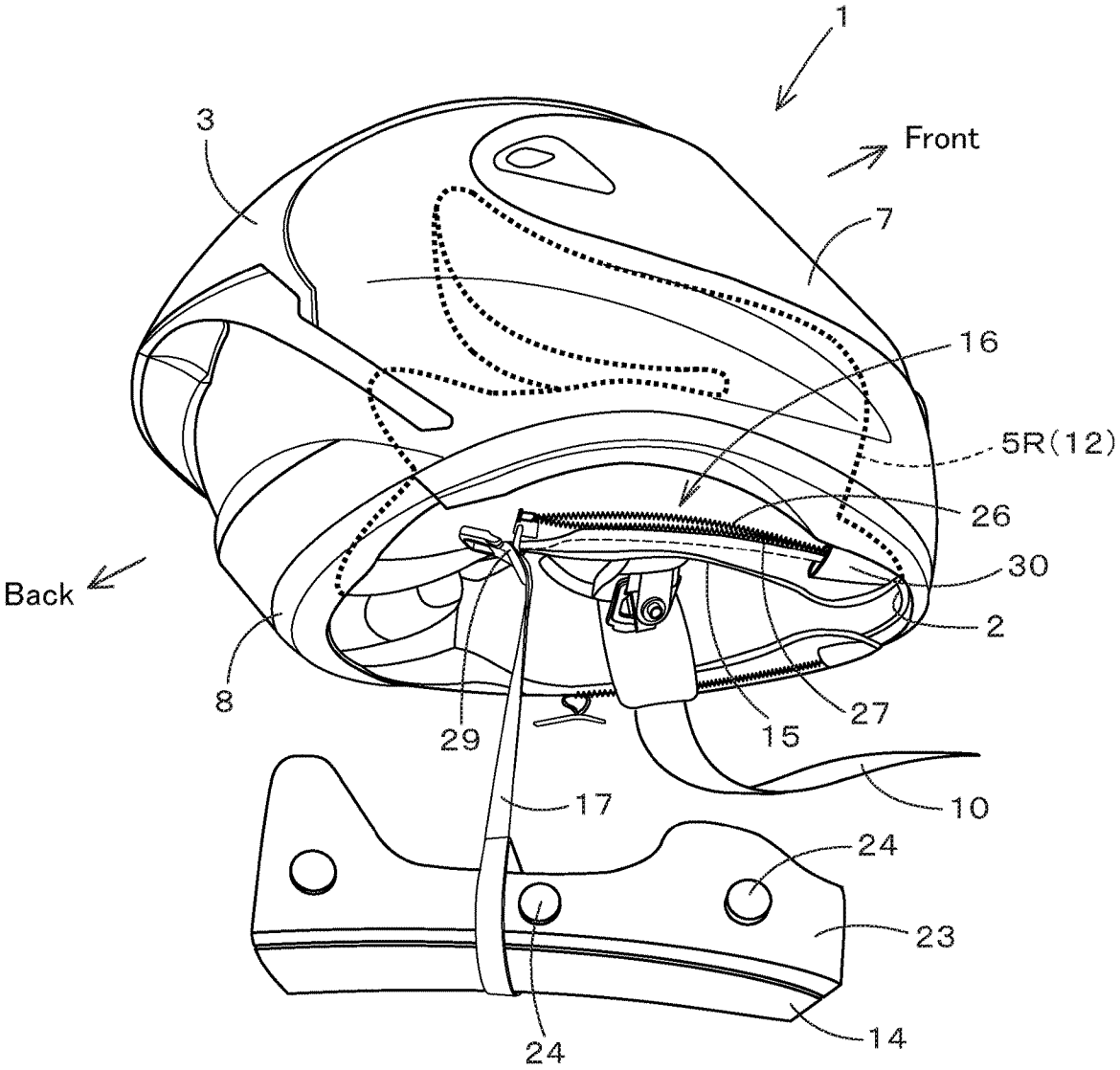
FIG. 3 is a side view of an emergency removal pad provided at a right side of the helmet according to the present embodiment.

FIG. 3 illustrates the emergency removal pad 12 viewed from the lower right. As illustrated in FIG. 3, the above-described emergency removal pad 12 (right cheek pad 5R) includes the pad bag 15 having a hollow interior and the pad body 14 disposed in the pad bag 15. The pad bag 15 has an opening 15*a*, and the opening 15*a* is provided with a pad removal part 16 that enables removal of the pad body 14 from the pad bag 15, which is attached to the inner periphery of the head covering shell 3. In the present embodiment, the above-described opening in the pad bag 15 is formed in the bottom surface (lower surface) of the pad bag 15. A connecting member 17 that connects the pad body 14 to the pad bag 15 is provided between the pad body 14 and the pad bag 15.

The pad bag 15, the pad body 14, the pad removal part 16, and the connecting member 17 that constitute the above-described emergency removal pad 12 will now be described in detail.

Figure 4:
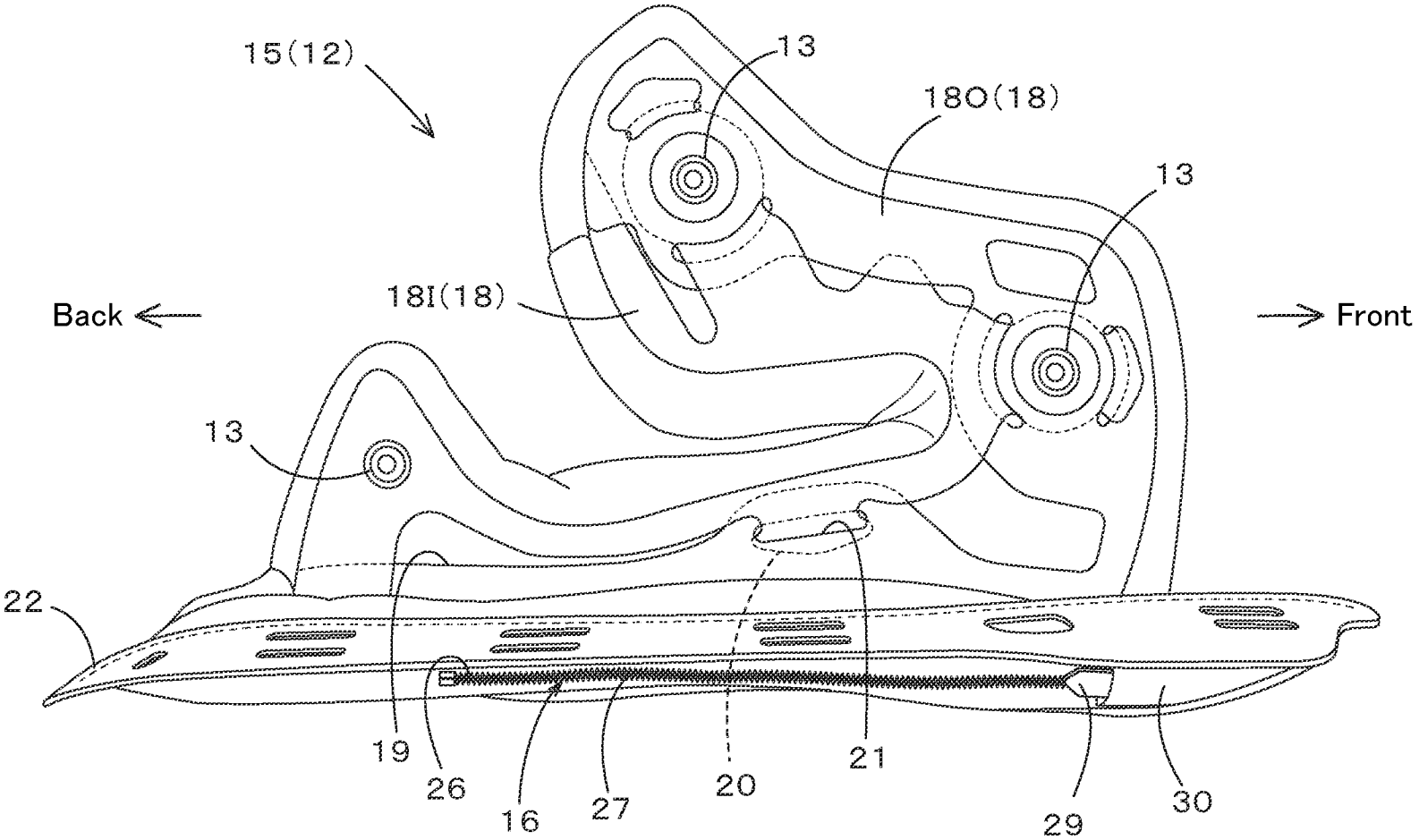
FIG. 4 is a right side view of a right pad bag.
Figure 5:
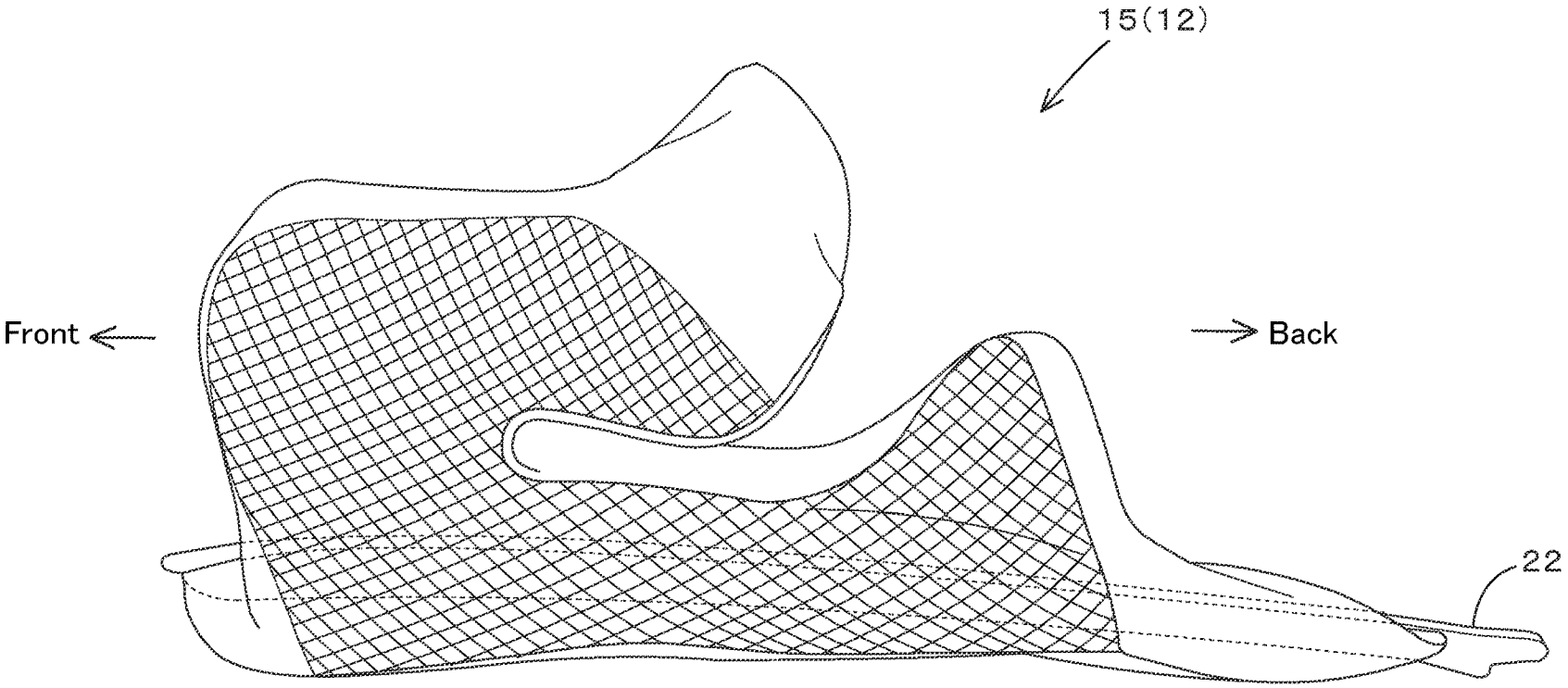
FIG. 5 is a left side view of the right pad bag.
Figure 6:
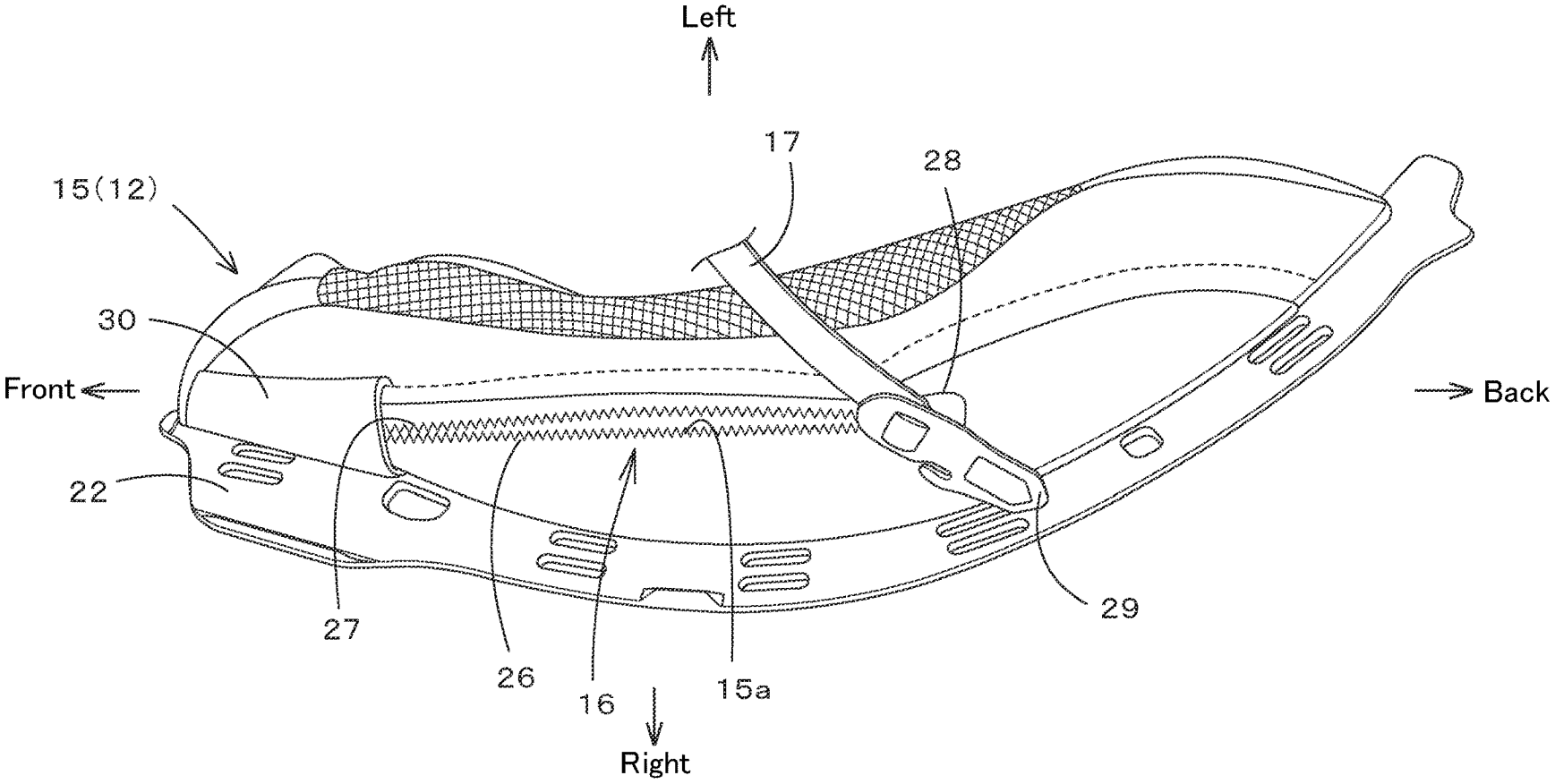
FIG. 6 is a bottom view of the right pad bag.

As illustrated in FIGS. 4 to 6, the above-described pad bag 15 is a member having a hollow interior in which the pad body 14 can be disposed, and is formed in a bag shape by using a fabric material. In the present embodiment, the pad bag 15 has a substantially rectangular shape with the left side open when viewed from the right, and is formed to have an opening that extends therethrough in an inside-outside direction in a central front region thereof. When the pad bag 15 has the above-described shape, the corresponding chin strap 10 may be disposed to extend through the central portion of the pad bag 15 (opening extending therethrough) toward the inner periphery of the cushion pad 5.

An inner peripheral portion of the pad bag 15 is composed of a synthetic fiber fabric having high air permeability to reduce stuffiness and provide comfortable tactile feel to the user U. A portion of the pad bag 15 at the bottom (lower surface) is composed of synthetic leather, and the opening 15*a* (opening in the bottom surface), at which the pad removal part 16 described below is provided, is formed at the boundary between the synthetic leather and the synthetic fiber fabric. An outer peripheral portion of the pad bag 15 is composed of a plate (outer peripheral plate 18) made of, for example, a rigid synthetic resin.

More specifically, the outer peripheral plate 18 made of a synthetic resin, such as ABS, is provided on the outer peripheral surface of the pad bag 15. The outer peripheral plate 18 is formed by bending an elongated strip plate-shaped plate member into a substantially rectangular shape with one side open that matches the above-described shape of the pad bag 15.

The strip plate-shaped plate member that constitutes the above-described outer peripheral plate 18 has a cut slit 19 that divides the outer peripheral plate 18 at the center thereof in the width direction. Similarly to the outer peripheral plate 18, the cut slit 19 is formed to extend along a line bent in a substantially rectangular shape with one side open, so that the outer peripheral plate 18 can be divided into an inner plate 18I on the inner side of the cut slit 19 and an outer plate 18O on the outer side of the cut slit 19.

An engagement end 20 is formed on one of the inner plate 18I and the outer plate 18O described above, and an engagement portion 21, into which the engagement end 20 is inserted to fix the engagement end 20, is formed on the other one of the inner plate 18I and the outer plate 18O (in the present embodiment, the engagement end 20 is provided on the inner plate 18I and the engagement portion 21 is provided on the outer plate 18O). Thus, when the engagement end 20 on one plate is inserted into and engaged with the engagement portion 21 on the other plate, the inner plate 18I and the outer plate 18O are fixed to each other in an interlocking state, so that the opening of the cut slit 19 can be closed. When the outer peripheral plate 18 of the pad bag 15 is formed of the inner plate 18I and the outer plate 18O that are detachably engageable with each other, the pad body 14 can be easily taken out from and put into the pad bag 15 through the cut slit 19. Accordingly, replacement of components and maintenance of the pad body 14 can be facilitated, and the user friendliness of the helmet 1 can be further increased.

Engagement parts 13, which are engageable with the above-described engagement parts 32, are attached to a surface of the above-described outer peripheral plate 18. More specifically, the above-described engagement parts 32 are attached to the inner peripheral surface of the lower absorbing body 4D of the shock absorbing body 4, and the engagement parts 13 are attached to the outer peripheral surface of the outer peripheral plate 18 at positions corresponding to the positions of the engagement parts 32. Thus, the pad bag 15 can be fixed to the inner periphery of the lower absorbing body 4D (shock absorbing body 4) by bringing the engagement parts 32 and the engagement parts 13 into engagement with each other.

An insertion guide plate 22 used to attach the pad bag 15 at a position such that the bottom end of the pad bag 15 is flush with the bottom end of the head covering shell 3 is formed on a lower portion of the right side surface of the pad bag 15. The insertion guide plate 22 is composed of a thin plate material made of a synthetic resin, and is insertable into a narrow gap between the right cheek covering portion 3R of the head covering shell 3 and the lower absorbing body 4D of the shock absorbing body 4. The insertion guide plate 22 is formed by using a synthetic resin, such as PE or PP, that allows a certain amount of elastic deformation, so that the insertion guide plate 22 can be bent along the curved inner peripheral surface of the head covering shell 3. Accordingly, by inserting the insertion guide plate 22 into the above-described gap from below, the insertion guide plate 22 can be fitted to the gap and fixed. As a result, the pad bag 15 can be fixed to the lower absorbing body 4D (shock absorbing body 4) such that the bottom end thereof is positioned to be flush with the bottom end of the head covering shell 3. In other words, the insertion guide plate 22 constitutes positioning means for attaching the pad bag 15 at a position such that the bottom end of the pad bag 15 is flush with the bottom end of the head covering shell 3.

Figure 7:
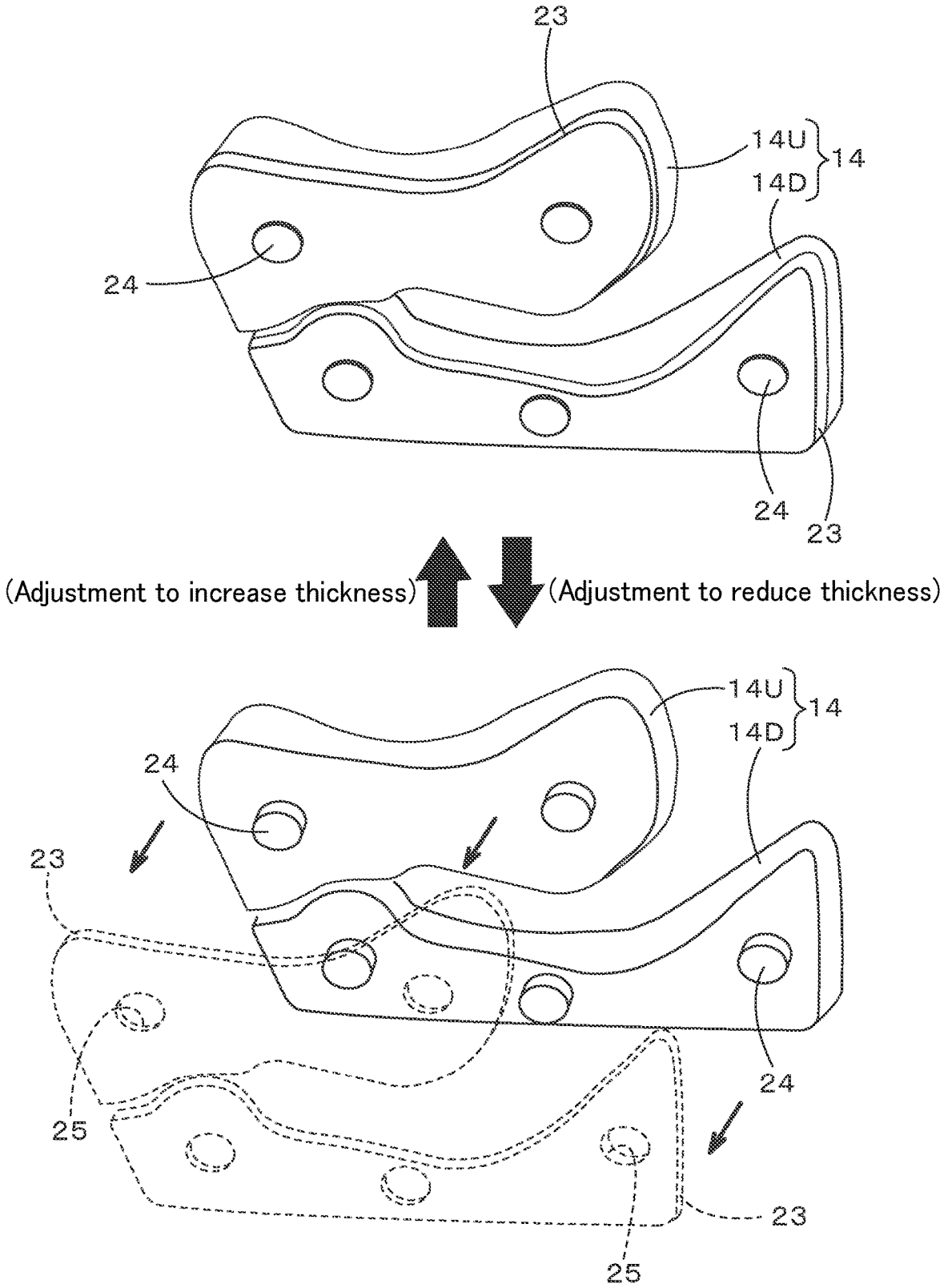
FIG. 7 illustrates the manner in which a thickness increasing pad is attached to and removed from a pad body (left pad body).

As illustrated in FIG. 7, the pad body 14 is a member that can be disposed in the above-described pad bag 15, and is composed of an angularly formed elastic member made of urethane foam or the like so that shock to the head can be reduced.

More specifically, the above-described pad body 14 includes an upper pad 14U disposed in an upper section of the pad bag 15 and a lower pad 14D disposed in a lower section of the pad bag 15. The upper pad 14U and the lower pad 14D are separable from each other, and are disposed in the pad bag 15 such that they are combined together in the up-down direction. When the pad body 14 is composed of the upper pad 14U and the lower pad 14D that are separable from each other as described above, the lower pad 14D can be taken out through the pad removal part 16 while the upper pad 14U remains in the pad bag 15. Thus, the pad body 14 can be easily taken out from the pad bag 15.

In particular, assuming that the pad bag 15 has a substantially rectangular shape with one side open in consideration of the position of the ear of the user U and the attachment of the chin strap 10 as in the present embodiment, if the pad body 14 is also formed in a substantially rectangular shape with one side open, the pad body 14 cannot be easily taken out due to physical interference between the pad body 14 and the pad bag 15. In contrast, when the pad body 14 is configured to be dividable in the up-down direction so that only the lower pad 14D can be taken out, the pad body 14 can be easily taken out without physical interference even when the pad bag 15 and the pad body 14 are formed in a complex shape.

The pad body 14 according to the present embodiment is dividable not only in the up-down direction but also in the inside-outside direction. More specifically, the pad body 14 includes a thickness increasing pad 23 with which the thickness of the pad body 14 in the inside-outside direction can be increased and thickness-increasing-pad attachment portions 24 with which the thickness increasing pad 23 is attached to the pad body 14.

The above-described thickness increasing pad 23 is composed of the same elastic member as that of the pad body 14, and the thickness thereof is about ⅙ to about ⅓ of the thickness of the pad body 14. Five attachment holes 25 are formed in the surface of the thickness increasing pad 23, and the thickness increasing pad 23 can be attached to the outer peripheral surface of the pad body 14 by using the attachment holes 25. More specifically, the thickness-increasing-pad attachment portions 24 can be inserted into the above-described attachment holes 25. The thickness-increasing-pad attachment portions 24 are projections formed on the outer peripheral surface of the pad body 14. The thickness-increasing-pad attachment portions 24 are formed in the shape of a rod having an outer diameter that is slightly greater than the inner diameter of the attachment holes 25. When the thickness-increasing-pad attachment portions 24 are inserted into the attachment holes 25, the attachment holes 25 are elastically deformed in a direction such that the openings expand (direction in which the opening diameter increases). After the insertion, restoring force is naturally generated in a direction such that the expanded attachment holes 25 contract, so that the thickness-increasing-pad attachment portions 24 are fixed and prevented from being pulled out from the expanded attachment holes 25 by the restoring force. Thus, the thickness increasing pad 23 can be securely attached to the outer periphery of the pad body 14 by inserting the thickness-increasing-pad attachment portions 24 into the attachment holes 25.

When the above-described thickness increasing pad 23 is attachable to the pad body 14, the thickness of the pad body 14 can be finely adjusted simply by attaching or removing the thickness increasing pad 23 as appropriate. Therefore, comfort and usability, such as removability, of the helmet 1 can be further improved.

The pad removal part 16 is provided on the bottom surface of the above-described pad bag 15, and enables the pad body 14 to be taken out from the pad bag 15.

More specifically, the opening 15*a* that extends straight in the front-back direction is formed in the bottom surface of the above-described pad bag 15. The opening 15*a* extends through the bottom surface of the pad bag 15 in the up-down direction. The opening 15*a* in the pad bag 15 has an opening width that is shorter than the above-described pad body 14. The above-described pad removal part 16 is provided on the opening 15*a* in the bottom surface of the pad bag 15.

The above-described pad removal part 16 is a member generally referred to as a "zip fastener", and includes a first element 26, a second element 27, and a slider 28. The first 'element 26 and the second element 27 are provided along the opening edges of the above-described opening 15*a* in the bottom surface. The slider 28 causes the elements 26 and 27 to interlock with each other in a disengageable manner. In the present embodiment, the first element 26 is provided along the opening edge of the opening 15*a* in the bottom surface at the side adjacent to the outer periphery, and the second element 27 is provided along the opening edge of the opening 15*a* in the bottom surface at the side adjacent to the inner periphery. The first element 26 and the second element 27 have teeth capable of interlocking with each other. The above-described slider 28 moves forward along the opening 15*a* to bring the above-described teeth into an interlocked state, and rearward to bring the above-described teeth into a non-interlocked state.

The above-described slider 28 has a tag member 29 attached thereto to facilitate holding of the slider 28. A tag pocket 30 that receives the tag member 29 together with the slider 28 is provided at the front end of the opening 15*a* in the bottom surface. The tag pocket 30 is configured to be capable of receiving a front half of the above-described tag member 29, and the tag member 29 is partially placed in the pocket so that the slider 28 can be prevented from being moved by mistake. When the slider 28 can be concealed in the tag pocket 30 with only a back end portion of the tag member 29 being exposed, the slider 28 can be easily pulled out in case of emergency. Thus, the usability can be improved both in normal use and in case of emergency. When the tag member 29 is attached to the slider 28, the slider 28 can be pulled without mistakes in case of emergency, and the helmet 1 can be reliably removed. In addition, when the tag pocket 30 capable of receiving the tag member 29 is provided, the tag member 29 can be prevented from being pulled by mistake in normal use. When the tag member 29 is disposed such that a front end portion thereof is placed in the tag pocket 30 and that only a back end portion thereof is exposed, a display indicating the presence of the "emergency removal pad 12", for example, may be provided on the exposed back end portion of the tag member 29. Thus, the user friendliness of the helmet 1 can be further increased.

The connecting member 17 is a string-shaped member provided between the pad bag 15 and the pad body 14 to connect the pad body 14 to the pad bag 15. More specifically, one end of the connecting member 17 is formed in a loop, and the pad body 14 (lower pad 14D) is disposed to extend through the loop so that one end of the connecting member 17 is connected to the lower pad 14D. The other end of the connecting member 17 is attached to the tag member 29 of the above-described slider 28. When the above-described connecting member 17 is provided, the pad body 14 can be easily pulled out, and the pad body 14 pulled out from the pad bag 15 can be prevented from being lost.

Figure 8:
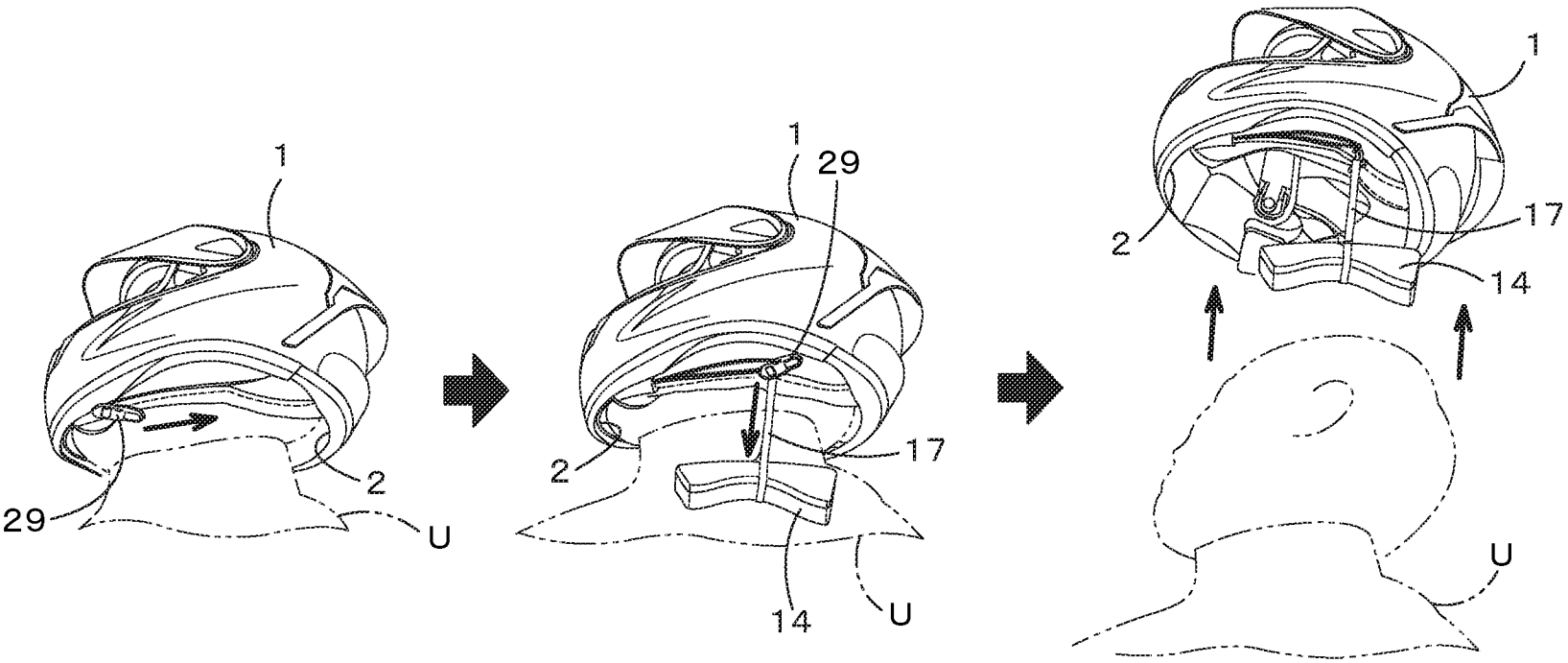
FIG. 8 illustrates the procedure of removing, from a user, the helmet according to the present embodiment.

As illustrated in FIG. 8, according to the helmet 1 including the above-described emergency removal pads 12, the helmet 1 can be easily and quickly removed from the head of the user U by a third person in case of emergency, such as an accident.

For example, assume that an emergency has occurred and the user U wearing the helmet 1 is unconscious. In such a case, it is preferable to quickly remove the helmet 1 from the head of the user U for first-aid treatment. However, if the helmet 1 is a full-face helmet having the structure of the related art, cushion pads around the neck serve as obstructions and it takes a lot of effort to remove the helmet.

In contrast, according to the helmet 1 of the present embodiment including the above-described emergency removal pads 12, the size of the cushion pads 5 around the neck can be reduced simply by taking out the pad body 14 from each emergency removal pad 12, so that the helmet 1 can be easily removed from the head of the user U. Since the pad body 14 (lower pad 14D) can be smoothly taken out from the pad bag 15, stress applied to the neck of the user U can be reduced. In addition, since the pad bag 15 from which the pad body 14 (lower pad 14D) has been taken out remains in the helmet 1, the pad bag 15 serves to protect the head of the user U when the helmet 1 is removed. This also helps to treat the body of the user U with care.

More specifically, the pad bag 15 is provided at the insertion opening 2 of the helmet 1 according to the present embodiment such that the pad bag 15 is flush with the bottom edge of the head covering shell 3. The pad bag 15 has the opening 15*a* that extends in the front-back direction in the bottom surface (lower surface) thereof. In normal use, the slider 28 is disposed at the front end of the above-described opening 15*a* in the bottom surface, and the first element 26 and the second element 27 of the pad removal part 16 interlock with each other so that the opening 15*a* in the bottom surface is closed.

To remove the helmet 1 from the head of the user U, first, the slider 28 at the front end of the opening 15*a* in the bottom surface is slid toward the back. The slider 28 is provided with the tag member 29. The front end portion of the tag member 29 is concealed in the tag pocket 30, but the back end portion of the tag member 29 is disposed outside the tag pocket 30. Therefore, it is easy to slide the slider 28 by holding the tag member 29.

When the slider 28 is moved toward the back as described above, the slider 28 moves toward the back while disengaging the interlock between the first element 26 and the second element 27. Therefore, the opening 15*a* in the bottom surface changes from the closed state to the open state in response to the backward movement of the slider 28.

When the slider 28 reaches the back end of the opening 15*a* in the bottom surface, the opening 15*a* in the bottom surface is completely open. The string-shaped connecting member 17 is pulled by the slider 28 to a position near the opening in the bottom surface (slightly above the opening). Thus, the above-described slider 28 has not only a function of opening the opening 15*a* in the bottom surface but also a function of pulling the string-shaped connecting member 17 to a position near the opening. Therefore, the connecting member 17 can be easily reached simply by inserting a finger slightly through the opening 15*a*, and the pad body 14 can be easily taken out.

The above-described opening 15*a* in the bottom surface has an opening width that is slightly shorter than the pad body 14, and therefore is not capable of allowing the long pad body 14 to be taken out therethrough in a physical sense. However, the pad body 14 is composed of an elastic member as described above, and therefore can be folded or bent in accordance with the short opening. Therefore, by holding the connecting member 17 and pulling the connecting member 17 downward, the pad body 14 can be pulled downward and taken out through the opening while the pad bag 15 remains attached to the shock absorbing body 4.

When the pad body 14 is taken out from each emergency removal pad 12 as described above, the pad bag 15 from which the pad body 14 is removed is reduced in size, and can be freely compressed. Therefore, the cushion pads 5 around the neck do not serve as obstacles, and the helmet 1 can be easily removed from the head of the user U.

Thus, according to the above-described helmet 1, the full-face helmet 1 (or an open face helmet that covers the head over a large area or a jet helmet), which generally cannot be easily removed, can be quickly and easily removed from the head of the user U simply by holding and sliding the tag member 29 of the pad removal part 16 and then pulling out the pad body 14 by holding the string-shaped connecting member 17. Therefore, in case of emergency, such as an accident, the helmet 1 can be quickly and easily removed by a third person, such as a person on the scene, a police officer, or a person from a fire station. Thus, the helmet 1 with improved safety and usability can be provided.

It is to be understood that the embodiment disclosed herein is illustrative in all respects and is not restrictive. In particular, matters that are not explicitly disclosed in the embodiment, such as driving conditions, operating conditions, various parameters, and sizes, weights, and volumes of components, are within an ordinary scope of implementation by a person skilled in the art, and values that are easily conceivable by an ordinary person skilled in the art are used.

In the above-described embodiment, the helmet 1 according to the present invention is a full-face helmet. However, the helmet 1 according to the present invention may instead be an open face helmet that covers the head over a large area or a jet helmet.

REFERENCE SIGNS LIST

1 helmet
2 insertion opening
3 head covering shell
3T top covering portion
3B back covering portion
3L left cheek covering portion
3R right cheek covering portion
3F chin covering portion
4 shock absorbing body
4U upper absorbing body
4D lower absorbing body
5 cushion pad
5T top pad
5L left cheek pad
5R right cheek pad
6 front opening window
7 shield (visor)
8 edge guard member
9 ventilating portion
10 chin strap
12 emergency removal pad
13 engagement part
14 pad body
14U upper pad
14D lower pad
15 pad bag
15*a* opening in pad bag (opening in bottom surface)
16 pad removal part
17 connecting member
18 outer peripheral plate
18I inner plate
18O outer plate
19 cut slit
20 engagement end
21 engagement portion
22 insertion guide plate
23 thickness increasing pad
24 thickness-increasing-pad attachment portion
25 attachment hole
26 first element
27 second element
28 slider
29 tag member
30 tag pocket
31 chin-strap guide hole
32 engagement part
U user

The invention claimed is:

1. A helmet comprising:

a head covering shell having an insertion opening that opens downward and configured to protect a head of a user;

a shock absorbing body disposed adjacent to an inner periphery of the head covering shell to reduce shock to the head of the user; and a cushion pad disposed adjacent to an inner periphery of the shock absorbing body to fill a gap between the shock absorbing body and the head, wherein the cushion pad includes a cheek pad as an emergency removal pad at a position along an opening edge of the insertion opening, wherein the emergency removal pad includes a pad bag having a hollow interior, a pad body disposed in the pad bag, and a pad removal part that enables the pad body to be taken out from the pad bag attached to the opening edge of the insertion opening, wherein the emergency removal pad includes a connecting member which is a string-shaped member disposed between the pad bag and the pad body to connect the pad body to the pad bag, and wherein the connecting member includes a first end connected to the pad body and a second end connected to the pad bag.

2. The helmet according to claim 1, wherein the pad removal part includes a first element disposed at an opening edge of an opening formed in the pad bag at one side of the opening; a second element disposed at an opening edge of the opening at other side of the opening, the second element being capable of interlocking with the first element; and a slider that causes the first element and the second element to interlock with each other in a disengageable manner, and wherein the second end of the connecting member is connected to the slider of the pad removal part.

3. The helmet according to claim 2, wherein the pad body includes an upper pad disposed in an upper section of the pad bag, and a lower pad disposed below the upper pad in the pad bag, the lower pad being separable from the upper pad, wherein the emergency removal pad is configured to allow the lower pad to be taken out through the pad removal part while the upper pad remains in the pad bag.

4. The helmet according to claim 3, wherein the emergency removal pad includes a thickness increasing pad capable of increasing a thickness of the pad body in an inside-outside direction and a thickness-increasing-pad attachment portion with which the thickness increasing pad is attached to the pad body.

5. The helmet according to claim 2, wherein the emergency removal pad includes a thickness increasing pad capable of increasing a thickness of the pad body in an inside-outside direction and a thickness-increasing-pad attachment portion with which the thickness increasing pad is attached to the pad body.

6. The helmet according to claim 1, wherein the emergency removal pad includes a thickness increasing pad capable of increasing a thickness of the pad body in an inside-outside direction and a thickness-increasing-pad attachment portion with which the thickness increasing pad is attached to the pad body.

* * * * *